US006347417B1

(12) United States Patent
Ohta

(10) Patent No.: US 6,347,417 B1
(45) Date of Patent: Feb. 19, 2002

(54) DRAIN PLUG DEVICE

(76) Inventor: Ikumi Ohta, 2800-31, Oaza Nao, Asahi-cho, Mie-Gun, Mie-ken (JP)

( * ) Notice: Subject to any disclaimer, the term of this patent is extended or adjusted under 35 U.S.C. 154(b) by 0 days.

(21) Appl. No.: 09/551,208

(22) Filed: Apr. 17, 2000

(51) Int. Cl.[7] ..... E03C 1/23

(52) U.S. Cl. ..... 4/689; 4/693; 4/679; 4/287; 4/295

(58) Field of Search ..... 4/693, 689, 679, 4/287, 295; 251/263, 294

(56) References Cited

U.S. PATENT DOCUMENTS 4,860,390 A 8/1989 Ohta

FOREIGN PATENT DOCUMENTS

| | | |
|---|---|---|
| DE | 2227790 | 12/1973 |
| DE | 3618709 | 12/1987 |
| JP | 9-324451 | 12/1997 |

OTHER PUBLICATIONS

English Language Abstract of JP 9–324451.

*Primary Examiner*—Gregory L. Huson
*Assistant Examiner*—Khou Huynh

(74) *Attorney, Agent, or Firm*—Greenblum & Bernstein, P.L.C.

(57) ABSTRACT

There is provided a stable drain plug device in which main bodies (the plug lid and the ascending or descending member) are not floated under a pushing operation of the operating part. In a drain plug device in which a hollow ascending or descending member suspended from a plug lid is supported in such a way that the member can be moved up and down at a guiding part arranged at a central part in a drain port, a supporting shaft is inserted from the lower end of the ascending or descending member into the ascending or descending member, one end of a releasing member is connected to an operating part arranged in a bath tub and the other end of the releasing member is connected to the plug lid, a forwarding motion of an inner wire operated by a pushing operation of the operating part causes the extremity end of the inner wire to be abutted against the supporting shaft 14, causes the plug lid to be lifted up together with the ascending or descending member to open the drain port, an engaging means for engaging a lower end of the supporting shaft is constituted between said guiding part and the lower end of the supporting shaft, floating of the main bodies (the plug lid and the ascending or descending member) of the device accompanied by an instantaneous pressing-down force of the supporting shaft with the inner wire under the pushing operation of the operating part are prevented by the engaging action of the engaging means constituted between the lower end of the supporting shaft and the guiding part.

6 Claims, 13 Drawing Sheets

DRAIN PLUG DEVICE

BACKGROUND OF THE INVENTION

1. Field of the Invention

This invention relates to a drain plug device used in a bath tub and a basin and the like for opening or closing a drain port every time an operating part is pushed.

2. Description of the Related Art

In the related art drain plug device, there has been provided a technology which is disclosed in the gazette of Japanese Patent Laid-Open No. Hei 9-324451.

As shown in FIG. 14, this related art technology is constituted such that a hollow mechanical box 55 suspended from a plug lid 4 is fitted into a cylindrical guiding part 3 having a bottom part therein arranged at a central part in a drain port 11 in such a way that it can be pulled out or inserted into it, a supporting shaft 14 is inserted into the mechanical box 55 from the lower end of the mechanical box 55, an operating part 6 is arranged in a bath tub 1, a releasing section S having one end connected to the operating part 6 is wired along the inner surface of the bath tub 1 in such a way that the releasing section may not become a hindrance, the other end of an outer tube s3 is connected to the side part of the plug lid 4 and then an inner wire s4 is positioned in the mechanical box 55 while being passed through the plug lid 4.

In this related art, when the operating part 6 is pushed, its extremity end strikes against the upper end of the supporting shaft 14 upon forwarding motion of the inner wire s4, and its further forwarding motion of the inner wire s4 pushes up the plug lid 4 together with the mechanical box 55 to open a drain port 11 (the plug is opened), a thrust lock mechanism 7 installed in the mechanical box 55 is locked and then a subsequent pushing operation for the operating part 6 causes the lock of the thrust lock mechanism 7 to be released to close the drain port 11 (the plug is closed).

Since this related art enables the drain port 11 to be opened or closed by the pushing operation for the releasing member S wired in the bath tub 1, it is possible to eliminate a troublesome state for a wiring work as found in a remote-operated drain plug device wired outside the bath tub or the basin and the like and to prevent a high cost caused by an increased number of component parts in reference to a prevention in leakage accompanied by its outside wiring and the like.

However, there was a possibility that the main bodies of the device comprised of the plug lid 4 and the mechanical box 55 are floated up under the instantaneous pushing-down force when the supporting shaft 14 strikes against the bottom part of the guiding part 3 upon reception of the pushing power of the operating part 6, resulting in that they are flown out of the guiding part 3.

In addition, the releasing member S was constituted such that its outer tube s3 was connected to the side part of the plug lid 4 and only an inner wire s4 was passed through the plug lid 4 with the inner wire being resiliently bent in a feeding hole 44 having a bent part 44*a* opened at the plug lid 4 and further drawn into the mechanical box 55, so that it showed a problem that a contact frictional resistance between the plug lid 4 made of synthetic resin and the feeding hole 44 for the inner wire s4, in particular at its bent part 44*a* became remarkably high to require a high force for pushing the operating part 6, resulting in that a poor convenience in use occurred.

In addition, in recent years, there has been present a request from a user using a bath tub and a basin having a rubber plug to open or close a drain port by pulling up a chain for changing this rubber plug into the aforesaid remote-operated drain plug device.

In view of the foregoing, since the aforesaid related art is of a type of inner bath tub wiring system, but is not of a type of outer bath tub wiring system, so that if the system is to be changed, it can be changed in a less-expensive manner without requiring any large-scaled work.

However, it is necessary that an exclusive drain port fixing member (a drain port fitting) having at the central part of the drain port the guiding part for use in guiding the aforesaid mechanical box in such a way that the box can be moved up and down is newly manufactured to be replaced with a drain port fixing member (a drain port fitting) for a rubber plug accommodation type, resulting in that a high cost of the member can not be avoided and its replacing work also requires a certain professional skill.

SUMMARY OF THE INVENTION

The present invention has been invented in view of the aforesaid circumstances described above and it is an object of the present invention to provide a stable drain plug device in which the main bodies (the plug lid and the ascending or descending member) of the device are not floated under the pushing operation of the operating part.

It is another object of the present invention to provide a drain plug device in which its operability is improved.

It is a still further object of the present invention to provide a remote-operated drain plug device in which the device can be easily fixed afterwards to the existing drain port.

The technical means applied for solving the aforesaid objects consists in providing a drain plug device in which a hollow ascending or descending member suspended from the plug lid is supported in such a way that the member can be moved up and down at a guiding part arranged at a central part in the drain port, a supporting shaft is inserted from the lower end of the ascending or descending member into the ascending or descending member, one end of a releasing member is connected to the operating part arranged in the bath tub and the other end of the releasing member is connected to the plug lid, a forwarding motion of the inner wire operated by the pushing operation of the operating part causes the extremity end of the inner wire to be abutted against the supporting shaft, causes the plug lid to be lifted up together with the ascending or descending member to open the drain port, wherein its gist consists in an arrangement in which an engaging means for engaging with the lower end of the supporting shaft is constituted between said guiding part and the lower end of the supporting shaft.

An engaging strength of said engaging means can be freely designed by a practical constitution employed in which the supporting shaft is engaged by such a force as one in which it can be manually replaced with another one or its engaged state is released only when its load of about several tens kilograms is acted on it.

In accordance with this constitution, the floating state of the main bodies (the plug lid and the ascending or descending member) accompanied with the instantaneous pushing-down force of the supporting shaft with the inner wire under a pushing action of the operating part are prevented by the engaging action of the engaging means constituted between the lower end of the supporting shaft and the guiding part.

In addition, the releasing member is constituted by the coil-like inner wire made of metallic material and the outer tube made of tetrafluoloetylene resin (fluoro resin) slidably guiding the inner wire, the releasing member is further preferable if it feeds the outer tube from the side part into the plug lid, bends it within the plug lid in a downward curved state, connects the other end of the tube to the bottom of the plug lid and guides the inner wire into the ascending or descending member.

In accordance with this configuration, since the inner wire in which the metallic material is formed into a coil shape has a sufficient durability against a pushing operation of the operating part and has a predetermined resiliency as compared with the linear wire, it has a flexibility which can be accommodated for its bending action. In addition, the outer tube formed of tetrafluoroethylene resin (fluoro resin) has a high durability against a tensile strength, an elongation of the inner wire caused by the sliding motion is scarcely produced and there is no possibility that a sliding stroke of the inner wire shows a dispersion. Further, since the frictional resistance is low, even if the inner wire is curved with a low curvature, a sliding characteristic of the inner wire is not damaged and further even if an inner circumferential surface of it is cut at the sliding location, fluoro resin particles may act as lubricant material and a smooth sliding motion of the inner wire is maintained for a long period of time. Due to this fact, even if the inner wire is bent in a downward curved state within the plug lid, the outer tube may keep a constant and smooth sliding performance of the inner wire for a long period of time.

In addition, it is preferable that the releasing member is drawn into the plug lid with its upward slant state being set toward the central part of the plug lid and the feeding port adjacent to the outside is slightly larger than a diameter of the releasing member.

In this configuration, the direction changing part of the releasing member (indicated by a reference symbol S') of which wiring is arranged to extend along the bath tub under the drawing action of the upward slant state is positioned at a lower location than that of the outer end feeding port as shown in FIGS. 2A and 2B, a resilient force generated at the direction changing part (indicated by the reference symbol S') is effectively utilized as a pressing force for pushing the plug lid in a direction where the plug lid is closely contacted with the drain port, and a clearance at the feeding port weakens the contact resistance generated between the releasing member during its use and the feeding port edge when the device is handled and its cut loss is prevented in advance.

Then, the aforesaid guiding part has integrally an annular flange around it through a drain space, the annular flange is mounted and fixed to the edge of the aforesaid drain port to enable the guiding part to be arranged at the center in the drain port, resulting in that if the guiding part is in integral with the annular flange part, the annular flange part is mounted and fixed to the edge part of the drain port fixing member (the drain port fitting) constituting the drain port, thereby the guiding part can be arranged at the central part in the drain port, and in the case that the guiding part is made separate from the annular flange part and it can be removably arranged from above against the annular flange, the annular flange is mounted and fixed to the edge of the drain port fixing member (the drain port fitting) constituting the drain port, thereafter it is engaged with the annular flange part and thus the guiding part can be arranged at the central part of the drain port.

That is, the remote-operated drain plug device can be installed afterwards to the bath tub and the basin and the like where the drain port can be opened or closed with the rubber plug.

In addition, in the case that the guiding part and the annular flange part are made separate, the guiding part is made separate from the annular flange to be mounted and fixed to the edge of the drain port fixing member (the drain port fitting) constituting the drain port to facilitate cleaning in the drain port.

Further, in the case that the aforesaid guiding part is made separate from the annular flange and the aforesaid guiding part is removably engaged with the annular flange from above, the guiding part can be engaged with or removed from it from above and thus a workability in the drain port as when the port is cleaned is improved.

DESCRIPTION OF THE PREFERRED EMBODIMENTS OF THE INVENTION

Figure 1:
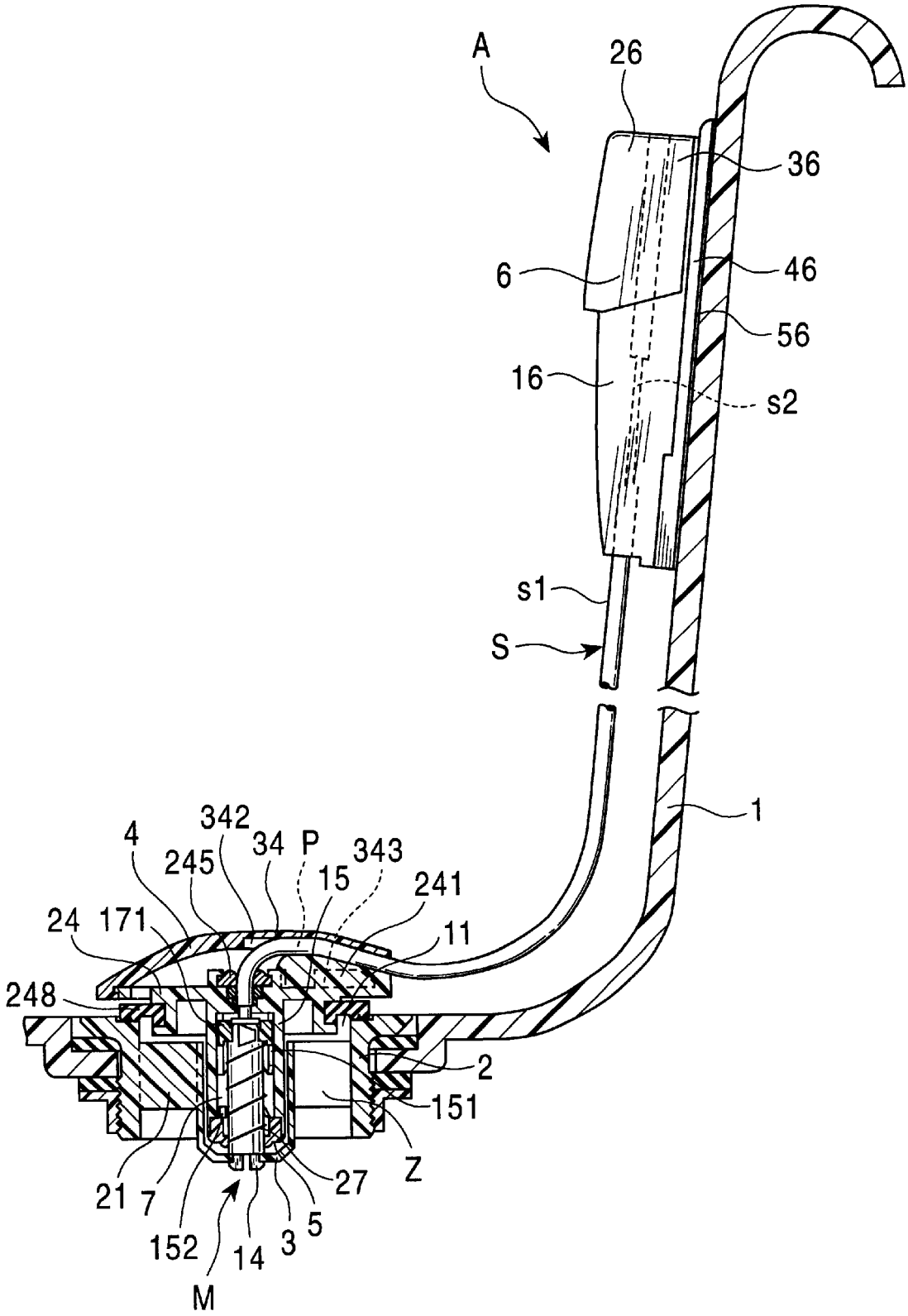
FIG. 1 is a front elevational view in section for showing a plug closed state of a first preferred embodiment.

Referring now to the drawings, some preferred embodiments of the present invention will be described as follows.

Figure 8A:
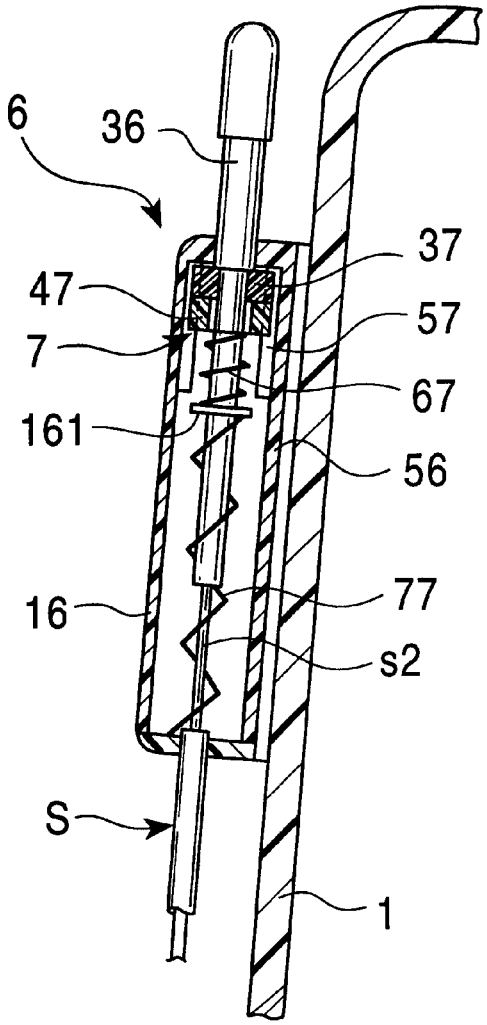
FIG. 8A is an enlarged sectional view for showing an operating part of a second preferred embodiment to illustrate a valve closed state.
Figure 8B:
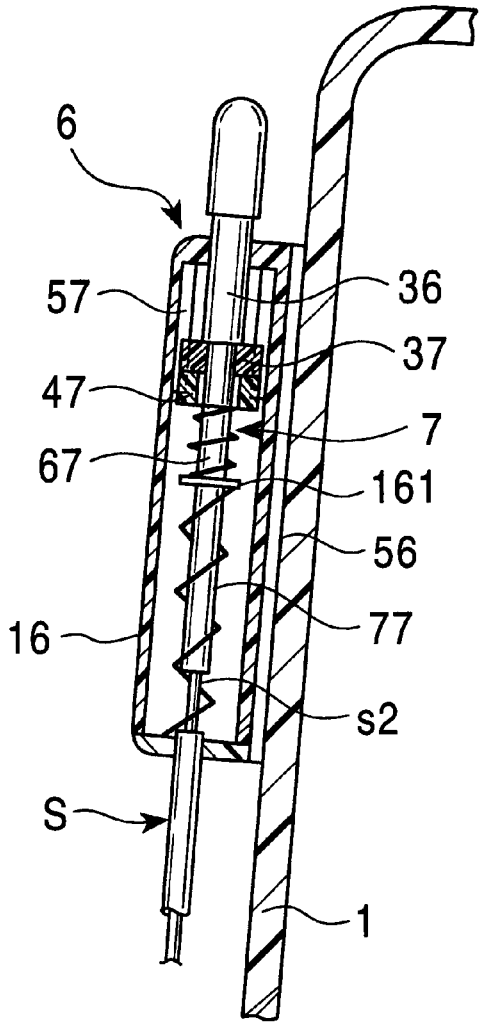
FIG. 8B is an enlarged sectional view for showing an operating part of a second preferred embodiment to illustrate a valve opened state.
Figure 9:
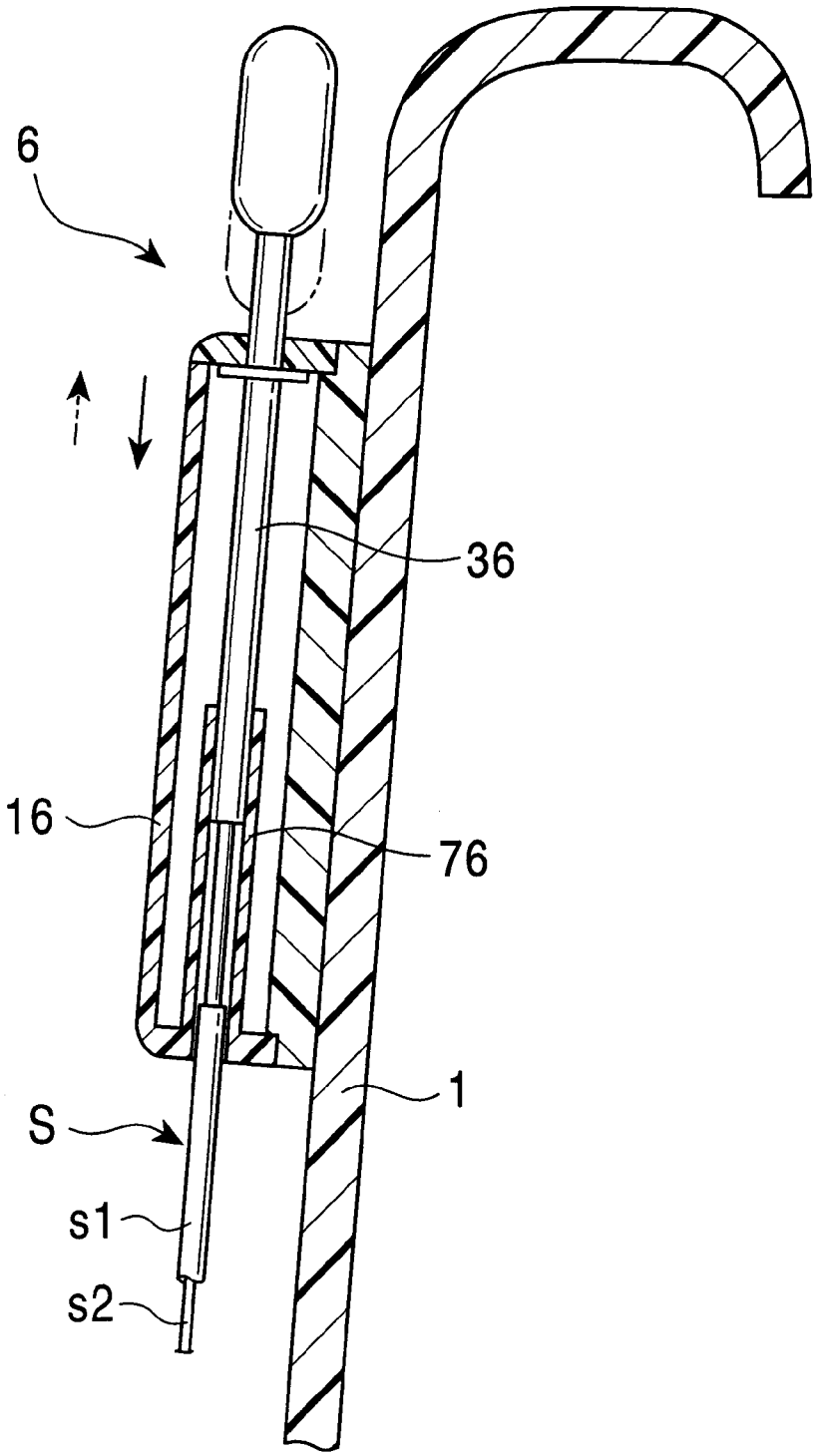
FIG. 9 is an enlarged sectional view for showing an operating part of a third preferred embodiment.
Figure 10:
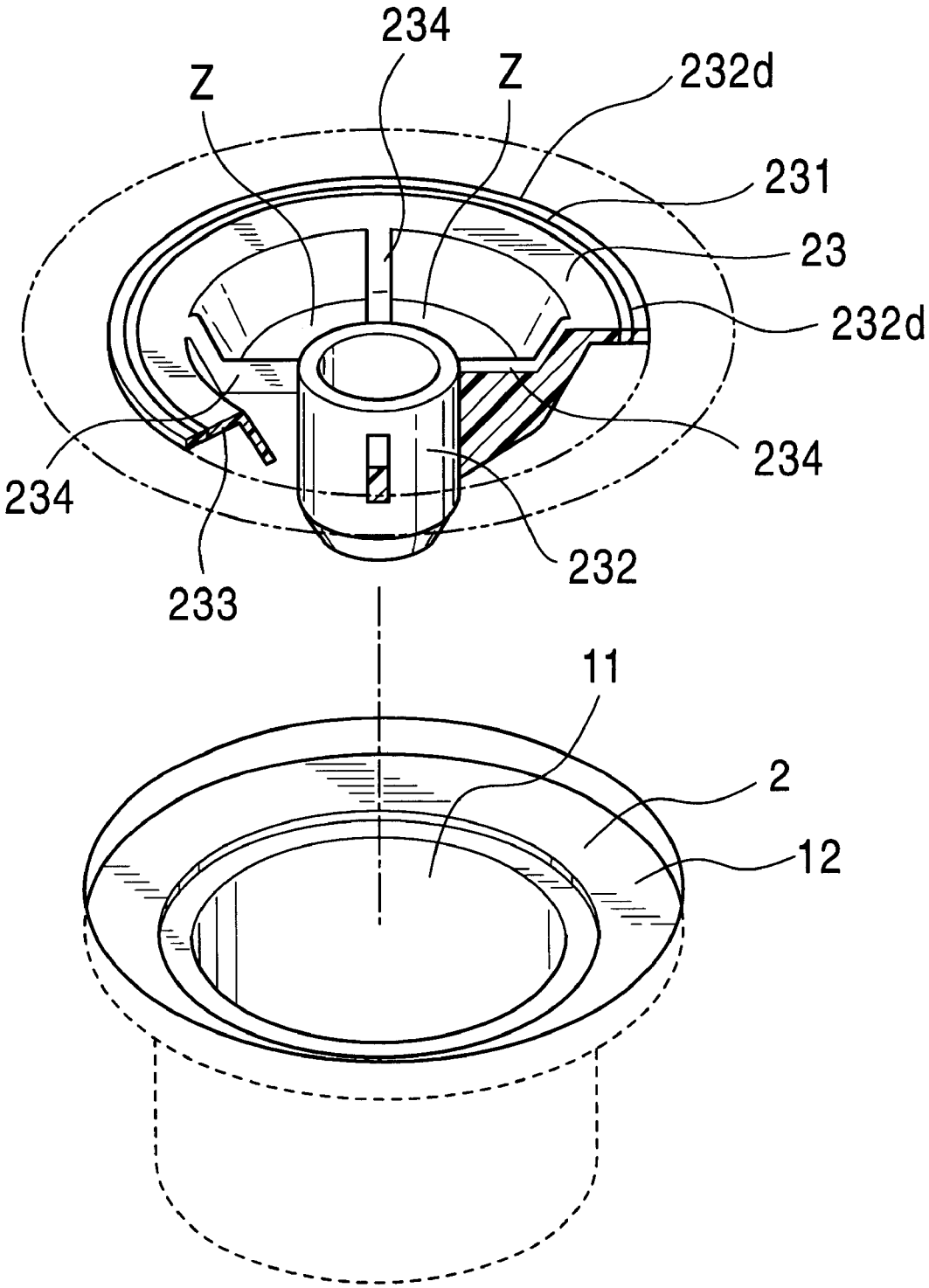
FIG. 10 is a perspective view for showing an attachment member used in a fourth preferred embodiment with a part being broken away.
Figure 11:
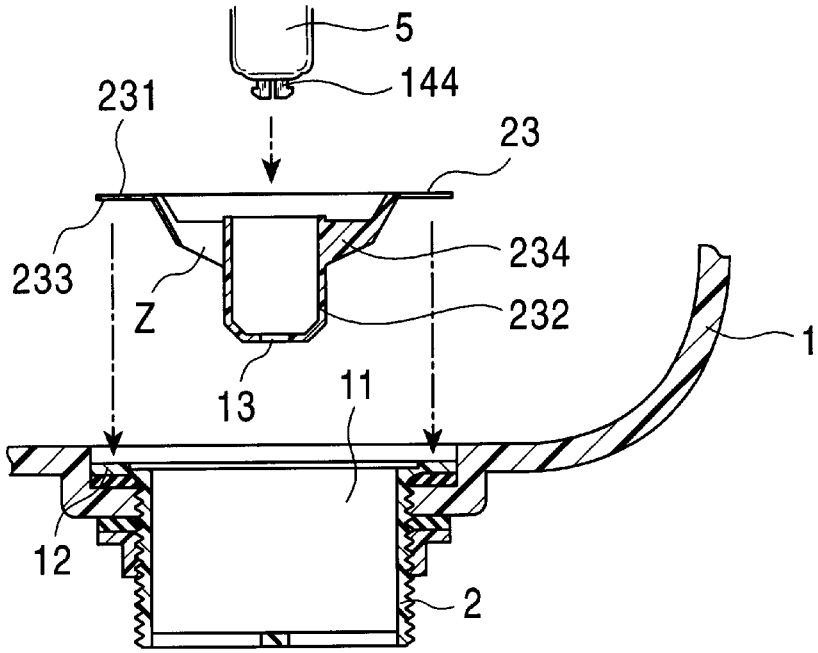
FIG. 11 is a front sectional view for showing a fixed state of an ascending or descending member together with an attachment member.
Figure 12:
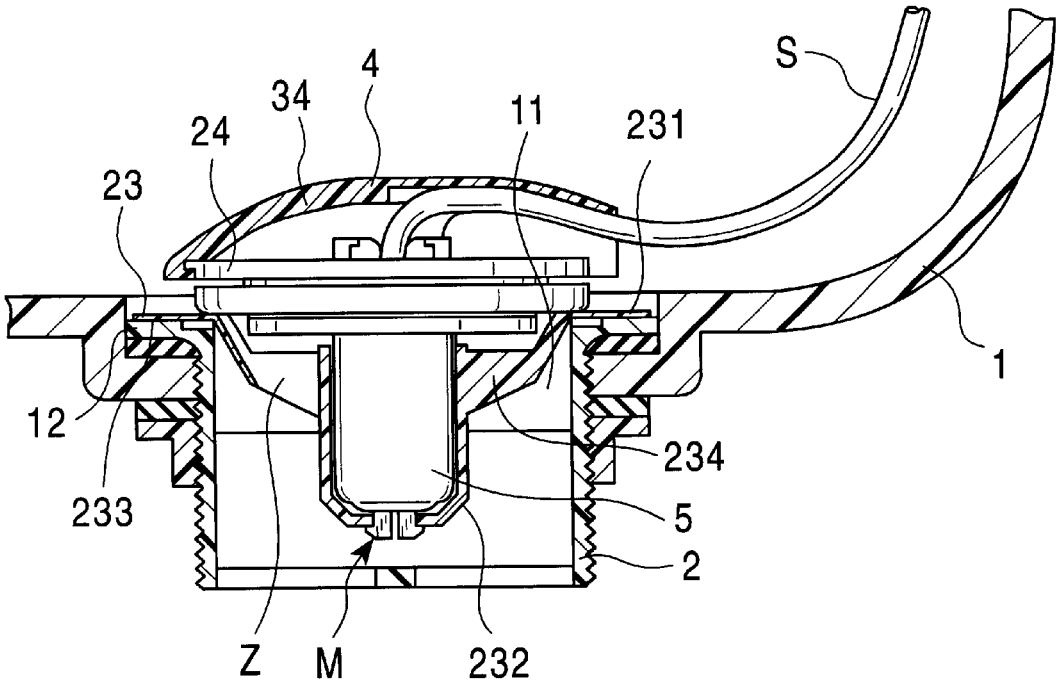
FIG. 12 is a front sectional view for showing a state of use in which an ascending or descending member is supported by an attachment member.
Figure 13:
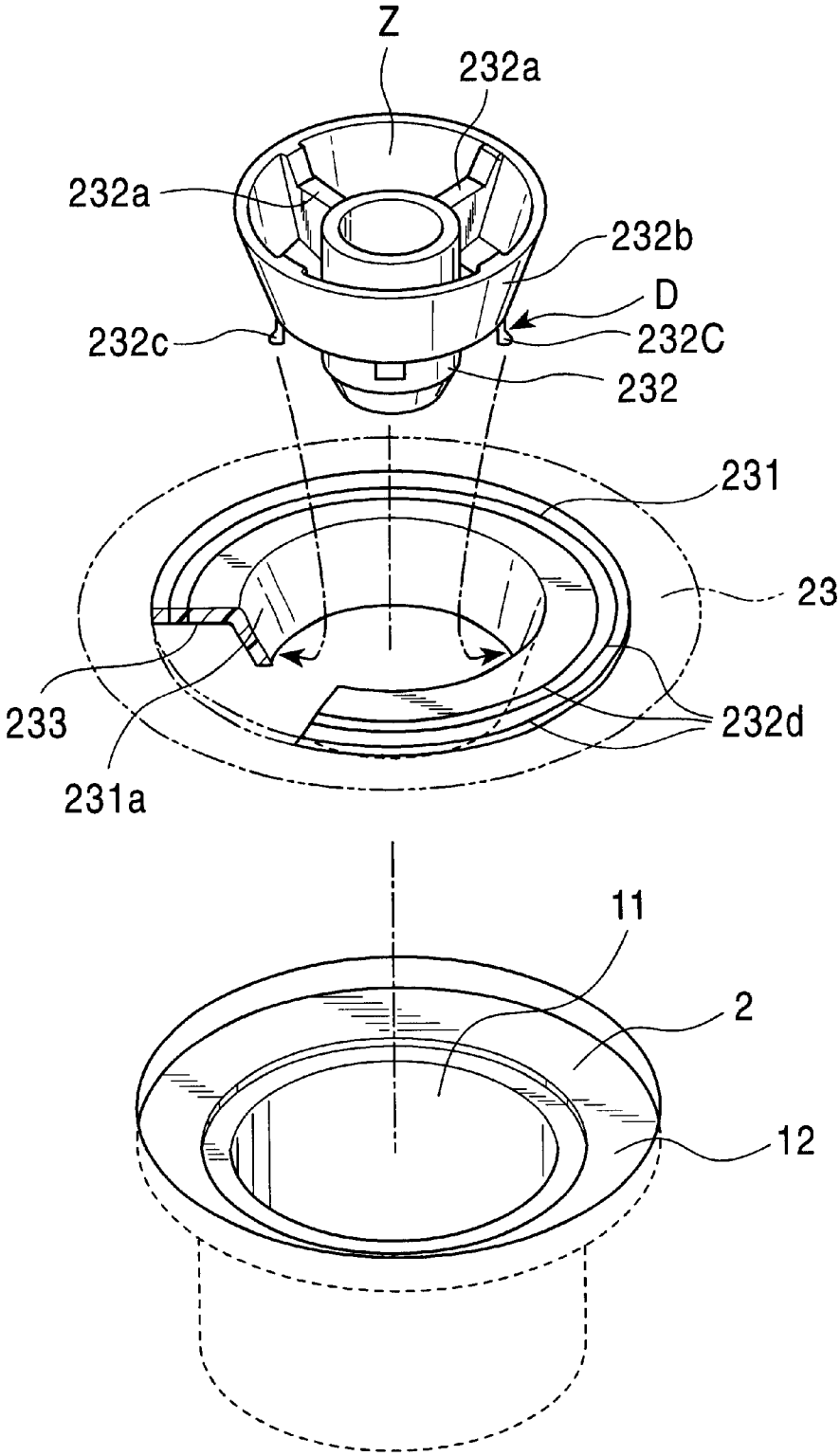
FIG. 13 is a perspective view for showing an attachment member used in a fifth preferred embodiment with a part being broken away.
Figure 14:
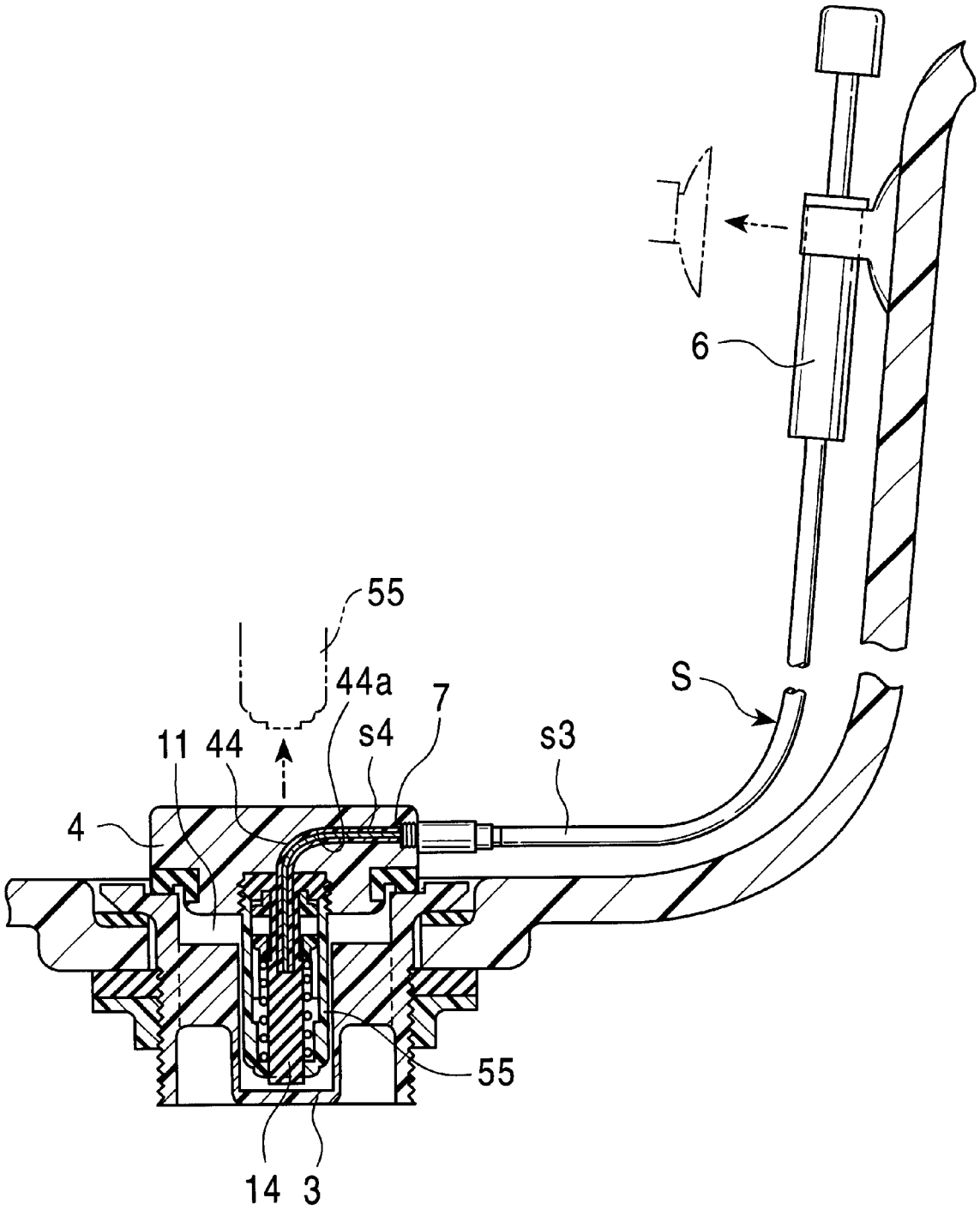
FIG. 14 PRIOR ART
FIG. 14 is a front sectional view for showing a state of use of a related art drain plug device.

FIGS. 1 to 7 illustrate a first preferred embodiment of the drain plug device of the present invention, FIG. 8 shows a second preferred embodiment of the drain plug device of the present invention, FIG. 9 shows a third preferred embodiment of the drain plug device of the present invention, FIGS. 10 to 12 show a fourth preferred embodiment of the drain plug device of the present invention, and FIG. 13 shows a fifth preferred embodiment of the drain plug of the present invention. At first, the first preferred embodiment will be described, wherein reference symbol A denotes a drain plug device.

This drain plug device A includes a drain port fixing member (a drain port fitting) 2 fixed to the opening of the bottom part of a bath tub 1 and constituting a drain port 11; a guiding part 3 arranged at a central part in the drain port 11; a plug lid 4; a hollow ascending or descending member (an ascending/descending member) 5 suspended from the plug lid 4; a supporting shaft 14 inserted and passed from the lower end of the ascending or descending member 5; an operating part 6 removably arranged at the inner surface of the bath tub 1; a releasing member S arranged within the operating part 6 and the aforesaid plug lid 4; and a thrust lock mechanism 7 arranged in the aforesaid ascending or descending member 5 and the like.

The ascending or descending member 5 is a hollow cylinder having the plug lid 4 integrally fixed to its upper end, and the supporting shaft 14 is inserted from a guide port 5' at the lower end of the cylinder in such a way that it can be moved up and down.

The guiding part 3 is a cylinder having a bottom part which is integrally formed with the aforesaid drain port fixing member (the drain port fitting) 2 through a supporting bracket 21 which is a cross-shape as viewed in its top plan or a fork-shape as viewed in its top plan, wherein its inner diameter is formed to be slightly larger than that of the ascending or descending member so as to enable the aforesaid ascending or descending member 5 to be guided in an upward or downward direction.

In addition, the drain port fixing member (the drain port fitting) 2 has a drain space Z in the supporting bracket 21.

As shown in FIG. 2A, FIG. 2B and FIGS. 4 to 7, the thrust lock mechanism 7 is comprised of a rotary ring 17 rotatably arranged at the upper end of the supporting shaft 14; engaging teeth 151 arranged at the side wall 15 of the ascending or descending member 5; fixed teeth 152 arranged at the bottom part of the ascending or descending member 5; and a spring 27 biasing the supporting shaft 14 in a pushing-up direction.

Figure 4:
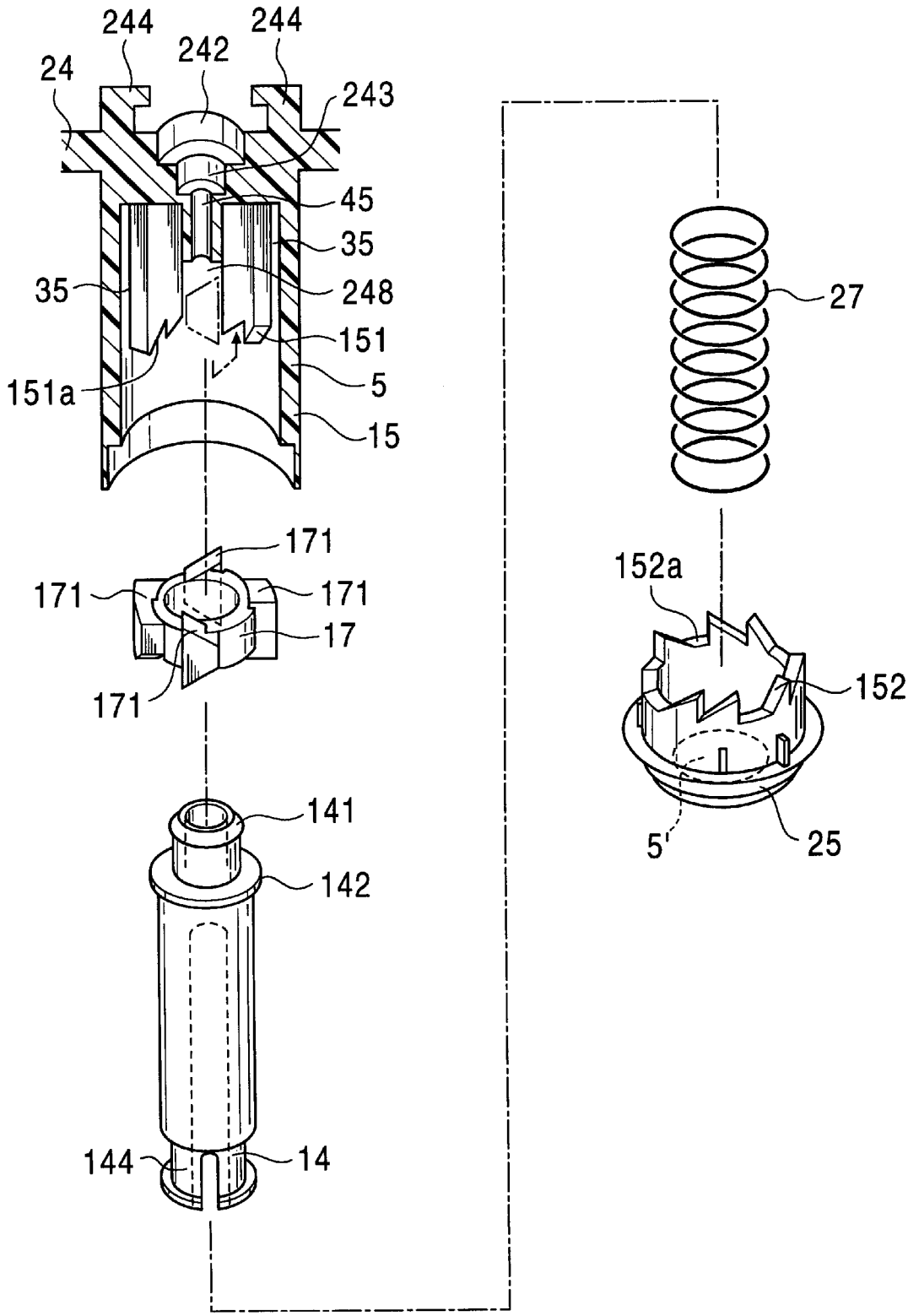
FIG. 4 is a developed view for showing a relation between an ascending or descending member and a thrust lock mechanism installed in the member.

As shown in FIG. 4, the rotary spring 17 is fitted between the upper and lower flanges 141, 142 arranged at the supporting shaft 14 in such a way that the ring may not be pulled out, and both upper and lower outer surfaces of it are provided with four engaging teeth 171 . . . spaced apart by 90° from each other and engaged with the engaging teeth 151 and the fixed teeth 152.

The aforesaid engaging teeth 171 . . . are formed into an approximate lateral faced trapezoidal shape with the upper end and the lower end being applied as slant surfaces, the upper end is engaged with saw-teeth 151*a* of the engaging teeth 151 to be described later and the lower end is engaged with the saw-teeth 152*a* of the fixed teeth 152 to be described later, respectively.

The fixed teeth 152 and the engaging teeth 151 are oppositely arranged in such a way that the aforesaid saw-teeth 152*a*, 151*a* are faced to each other.

The fixed teeth 152 are constituted such that a cap 25 for closing the bottom part in the ascending or descending member 5, and more particularly a lower releasing part of the ascending or descending member is formed with the aforesaid saw-teeth 151.

Four engaging teeth 151 are spaced apart by 900° from each other and formed at the side wall 15 of the ascending or descending member 5 and each of the lower ends of the four engaging teeth 151 . . . is formed with the aforesaid saw-teeth 151*a*, respectively.

Between the mutual teeth of the aforesaid four engaging teeth 151 in the aforesaid ascending or descending member 5 are cut and formed grooves 35 in which the upper engaging teeth 171 in the aforesaid rotary ring 17 are guided.

The spring 27 is present while being compressed between the aforesaid bottom part and the aforesaid lower flange (not shown) preventing the rotary ring 17 from being pulled out.

The releasing member S is comprised of a flexible outer tube s1 molded by tetrafluoroethylene resin material (fluoro resin) and a coil-formed inner wire s2 made of metallic material (stainless steel, for example) which is slidably inserted into the outer tube s1.

The operating part 6 is constructed such that the upper end of the outer tube s1 in the releasing member S is connected to the lower end of a releasing guide main body 16 having its surface part facing against the inner surface of the bath tub 1 and having its upper surface released together, the inner wire s2 is inserted into the releasing guide main body 16, the upper surface releasing part of the releasing guide main body 16 is closed by a push button 26 moved up and down along the releasing guide main body 16, the inner wire s2 is connected to the lower end of the operating shaft 36 having its upper end fixed to the push button 26, a rear lid 46 is engaged with a surface part opposing against the bath tub 1 at the releasing guide main body 16 and then it is fixed to a desired position of the inner surface of the bath tub 1 by a fixing means 56 such as a double-surface adhering tape or a suction plate or the like at the rear surface of the rear lid 46.

The plug lid 4 is of a hollow cylindrical shape comprised of a disc 24 and a convex-shaped lid part 34 engaged with the disc 24, the other end (the lower end side) of the releasing member S is fed from the side part of the lid part 34 toward the central side of the plug lid 4 in an upward inclined state (15°, for example) and held, and a diameter of its feeding port 341 is set to be slightly larger than a diameter of the releasing member S.

The holding part for the aforesaid releasing member S into the plug lid 4 constitutes a holding space P where the releasing member S is held while it is held in an upward slant state with a top bottom part of a raising section 241 raised from and formed by the disc 24 and the bottom section of a guide groove 342 indented at the inner surface of the lid part 34 opposing against the raising section 241, a part of the aforesaid feeding port 341 acting as an outer end of the holding space P is slightly larger than a diameter of the releasing member S so as to assure a clearance between the releasing member S and the edge part of the feeding port 341.

Reference numeral 343 denotes a pair of forward and rearward position setting pieces suspended from the edge of the aforesaid guide groove 342 and abutted against both side surfaces of the aforesaid raising part 241 to hold the raising part 241.

In addition, the aforesaid holding space P is assured in a length up to a position slightly before the central part of the plug lid 4, the releasing member S is curved from its extremity end in a downward direction with the holding space P being applied as a guide, its extremity end is liquid-tightly connected to the part just above the ascending or descending member 5 at the disc 24.

The aforesaid liquid-tight connected part is constructed such that a large diameter indentation 242 and a small diameter indentation 243 are set at upper and lower positions and coaxially indented at just a central part of the disc 24, the bottom part of the lower small diameter indentation 243 is opened with a through-pass hole 45 through which only the inner wire s2 is passed in the ascending or descending member 5, the extremity end of the outer tube s1 at the aforesaid releasing member S is set in position at the bottom part of the small diameter indentation 243, a part of an O-ring O arranged at the bottom of the large diameter indentation 242 through a washer W fixed to the outer tube s1 is fitted into the large diameter indentation 242 while it is being projected upward, an engaging member 245 having a fork-like engaging piece 245*a* is engaged with a pair of rails 244 arranged at the disc 24 while holding the large diameter indentation 242 and the small diameter indentation 243 therebetween in such a way that the engaging member can be pulled out of them, thereby the aforesaid O-ring O is depressed and the extremity end of the outer tube s1 is liquid-tightly connected to the disc 24.

Reference numeral 246 denotes a drain hole which is opened near a part except a holding margin of a packing 248 held by a packing receiver 247 projected between it and the ascending or descending member 5 at the lower surface of the aforesaid disc 24 so as to drain hot water moved forward through the aforesaid clearance and the like.

The other end (the lower end) of the inner wire s2 is positioned to pass through a guide cylinder 248 vertically installed to communicate with the aforesaid through-pass hole 45 and to abut against or approach the bottom part of the indentation 143 indented at the upper end of the supporting shaft 14 as shown in the figure.

In addition, between the lower end of the aforesaid supporting shaft 14 and the bottom part of the guiding part 3 is constituted an engaging means M to which the lower end of the supporting shaft 14 is engaged.

This engaging means M is constituted by an engaging hole 13 formed at the bottom part of the aforesaid guiding part 3 and an engaging indentation 144 indented near the lower end of the supporting shaft 14, the engaging indentation 144 is engaged with the engaging hole 13, thereby the supporting shaft 14 is prevented from being moved up and down.

In the preferred embodiment, at least the lower end of the supporting shaft 14 is cut and slitted to make an axial divided section and to provide a slight resiliency.

An object of this arrangement consists in enabling the main body of the device comprised of the plug lid 4, the ascending or descending member 5 and the supporting shaft 14 to be pulled out during maintenance operation and the like.

Action of the drain plug device constructed as above will be described as follows.

Figure 2A:
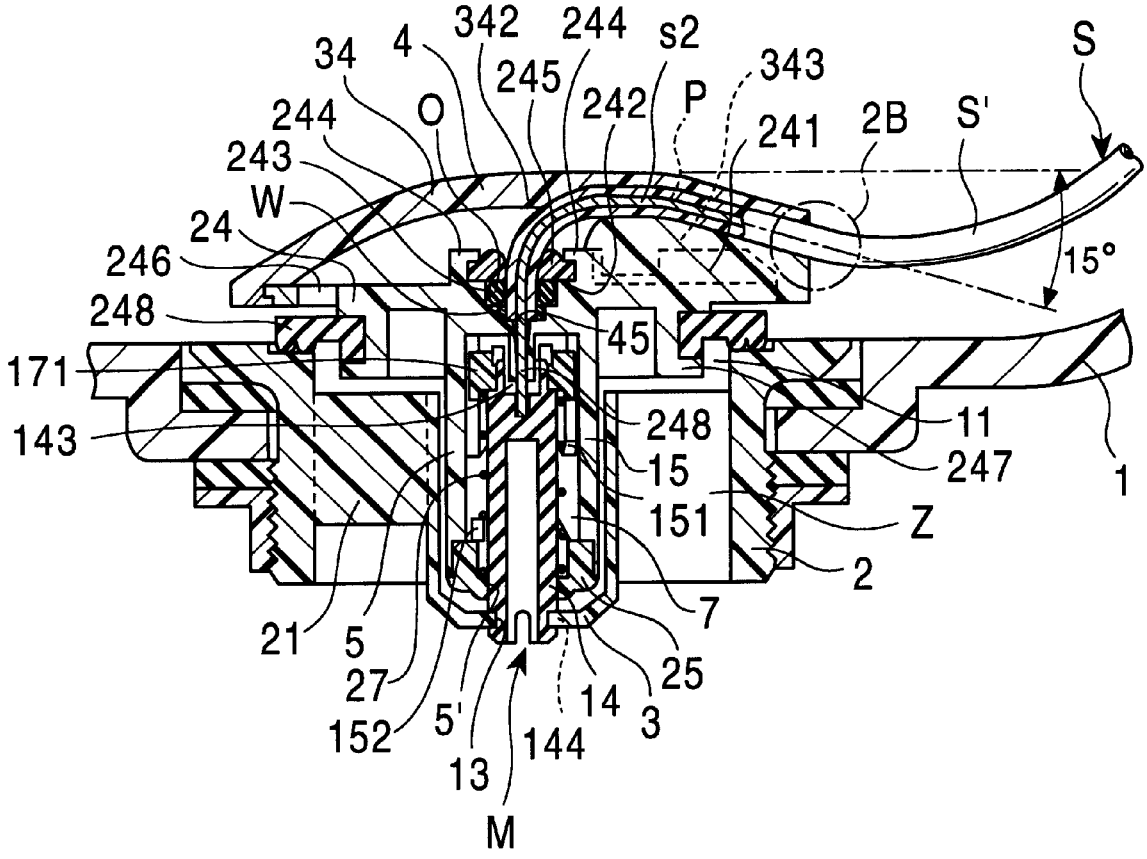
FIG. 2A is an enlarged sectional view of a substantial part to show a plug closed state.
Figure 2B:
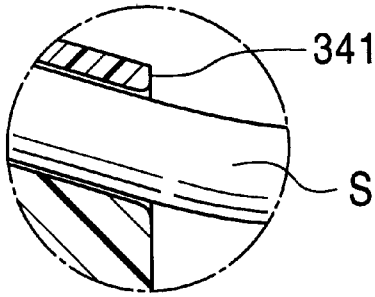
FIG. 2B is an enlarged sectional view for showing an inlet port part.
Figure 3:
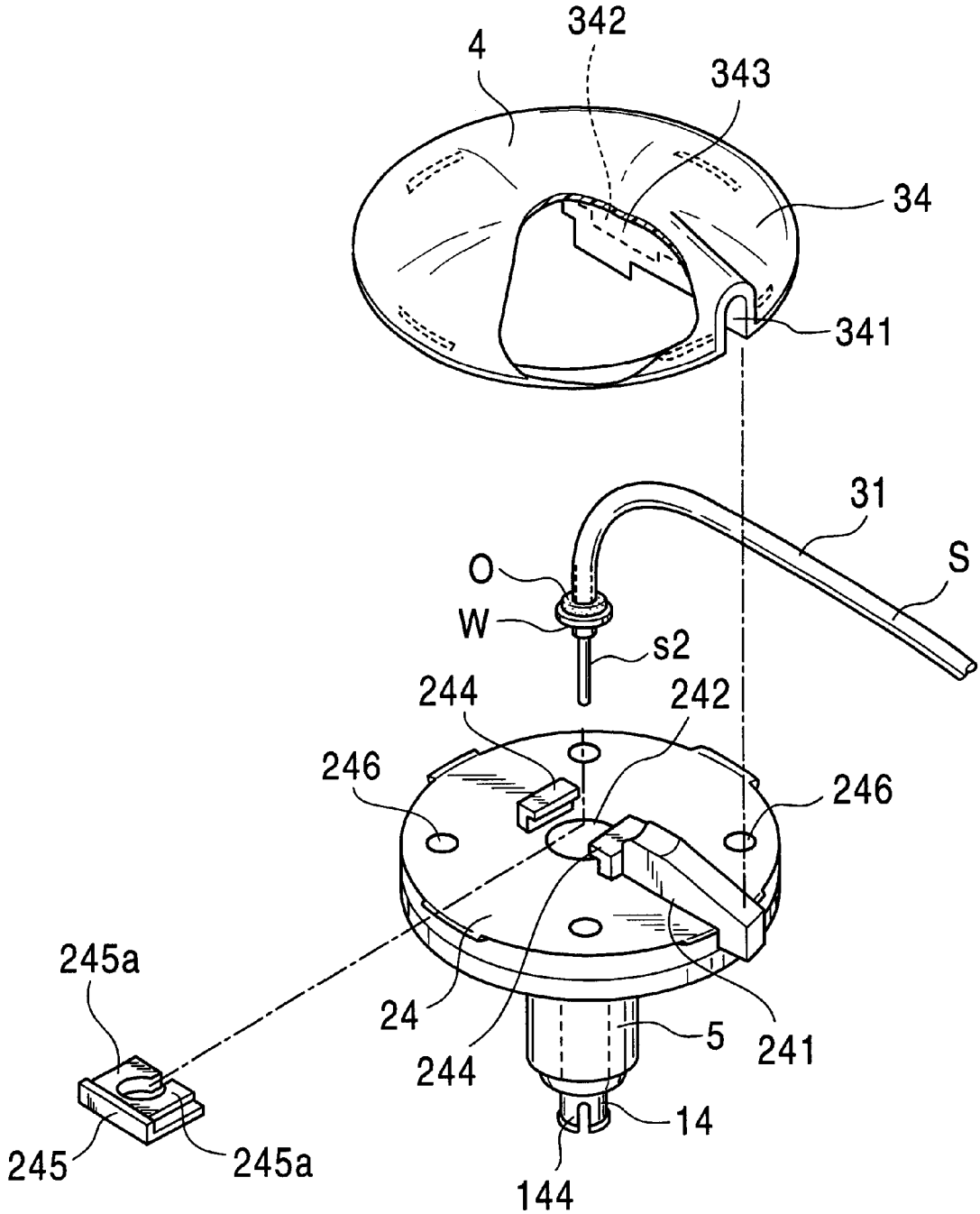
FIG. 3 is an exploded perspective view for showing a plug lid with a part being broken away.

The state of the device shown in FIGS. 1, 2A and 2B is a plug closed state. Under this plug closed state, the upper and lower engaging teeth 171, 171 of the rotary ring 17 are positioned in a region of the upper ends of the grooves 35.

Figure 5:
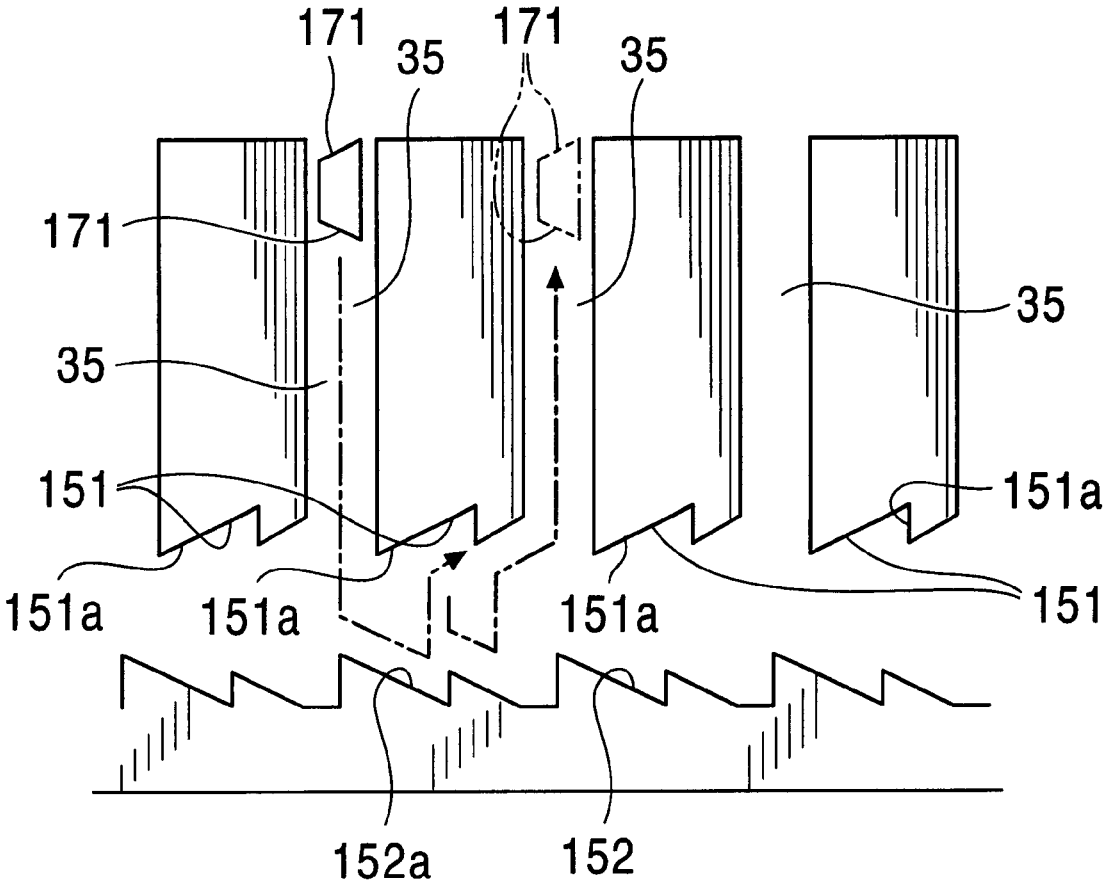
FIG. 5 is a developed view for showing a relation among engaging teeth of a rotary ring, stopper teeth and fixed teeth.
Figure 6A:
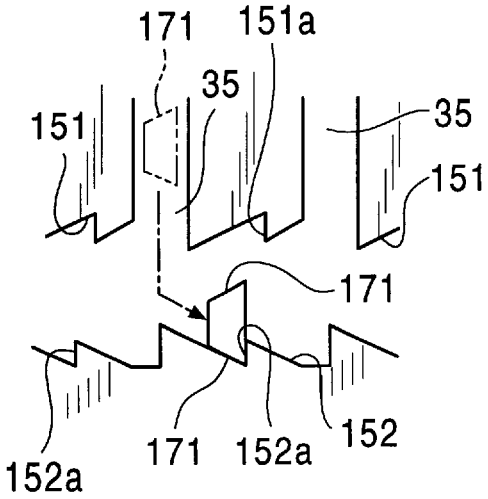
FIG. 6A is a developed view for showing a relation among engaging teeth of a rotary ring, stopper teeth and fixed teeth so as to illustrate a state of a plug during its opening operation in which an operating part is pushed and operated to cause the engaging teeth at the lower side of the rotary ring to be moved along slant surfaces of the saw-teeth of the fixed teeth.
Figure 6B:
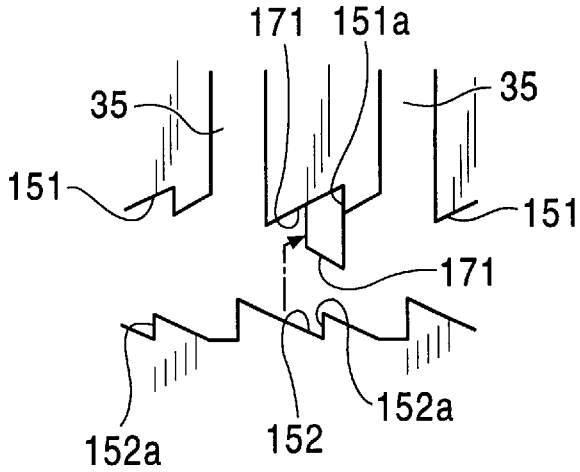
FIG. 6B is a developed view for showing a relation among engaging teeth of a rotary ring, stopper teeth and fixed teeth so as to illustrate a state of opening a plug in which a pushing operation is stopped and the engaging teeth at the upper side of the rotary ring are engaged with the saw-teeth of the engaging teeth.
Figure 6C:
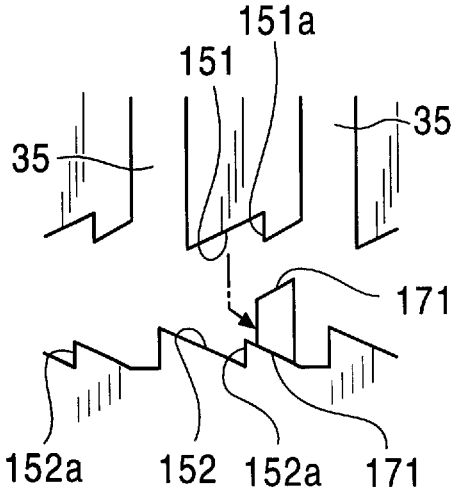
FIG. 6C is a developed view for showing a relation among engaging teeth of a rotary ring, stopper teeth and fixed teeth so as to illustrate a state in which a pushing operation is carried out to cause the engaging teeth at the lower side of the rotary ring to be guided by the slant surfaces of the saw-teeth of the engaging teeth at the lower side of the rotary ring.
Figure 6D:
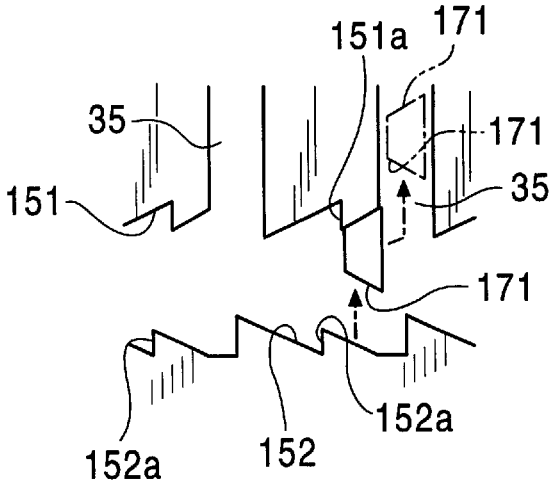
FIG. 6D is a developed view for showing a relation among engaging teeth of a rotary ring, stopper teeth and fixed teeth so as to illustrate a state in which a pushing operation is stopped, the engaging teeth at the upper side of the rotary ring are guided by the slant surfaces of the saw-teeth of the engaging teeth, and further moved at grooves to close a drain port to be closed with a plug.

When the push button 26 is pushed from the engaged state shown in FIGS. 1, 2A and 2B, i.e. the state shown in FIG. 5, the inner wire s2 is moved forward to push the supporting shaft 14. However, since the lower end of the supporting shaft 14 is engaged with the aforesaid engaging means M in such a way that it can not be moved up and down, the inner wire s2, unable to force the supporting shaft 14 downward, forces the movable ascending or descending member 5 upward. More particularly, the lower engaging teeth 171 of the aforesaid rotary ring 17 are guided by the grooves 35 while compressing the spring 27, the lower engaging teeth 171 are contacted with the saw-teeth 152*a* of the fixed teeth 152 and then the ascending or descending member 5 is lifted up until the engaging teeth are moved along the slant surfaces of the saw-teeth 152*a* as shown in FIG. 6A (the direction indicated by an arrow shows a moving-up or down direction of the ascending or descending member 5 and a rotating direction of the rotary ring 17, and its subsequent FIGS. 6B, 6C and 6D are also similarly applied). Then, upon stopping of the pushing operation of the push button 26, the saw-teeth 151*a* of the engaging teeth 151 descended upon receiving a biasing force of the aforesaid spring 27 are engaged with the upper engaging teeth 171 at the rotary ring 17 to cause the plug lid 4 to be spaced apart upward from the drain port 11 and opened (the plug is opened) (FIG. 7).

In the case that the plug kept at this plug opened state is closed again, the push button 26 is pushed, the ascending or descending member 5 is once lifted up against the biasing force of the spring 27, the lower engaging teeth 171 of the rotary ring 17 are contacted with the saw-teeth 152*a* of the fixed teeth 152 and concurrently the lower engaging teeth 171 are moved along the slant surfaces of the saw-teeth 152*a* (FIG. 6C), and then upon stopping of the pushing operation of the push button 26, the upper engaging teeth 171 of the rotary ring 17 are guided by the grooves 35 while the upper engaging teeth 171 of the rotary ring 17 are being guided by the slant surfaces of the saw-teeth 151*a* of the engaging teeth 151 descended under the biasing force of the spring 27, resulting in that the ascending or descending member 5 is lowered down to the states shown in FIGS. 1, 2A and 2B to close the port (close the plug) as described above (FIG. 6D).

The releasing member S communicating with the operating part 5 and the plug lid 4 is wired along the inner surface of the bath tub 1 while providing no hindrance against a user. Action of the drain plug device constituted as above will be described as follows.

Figure 7:
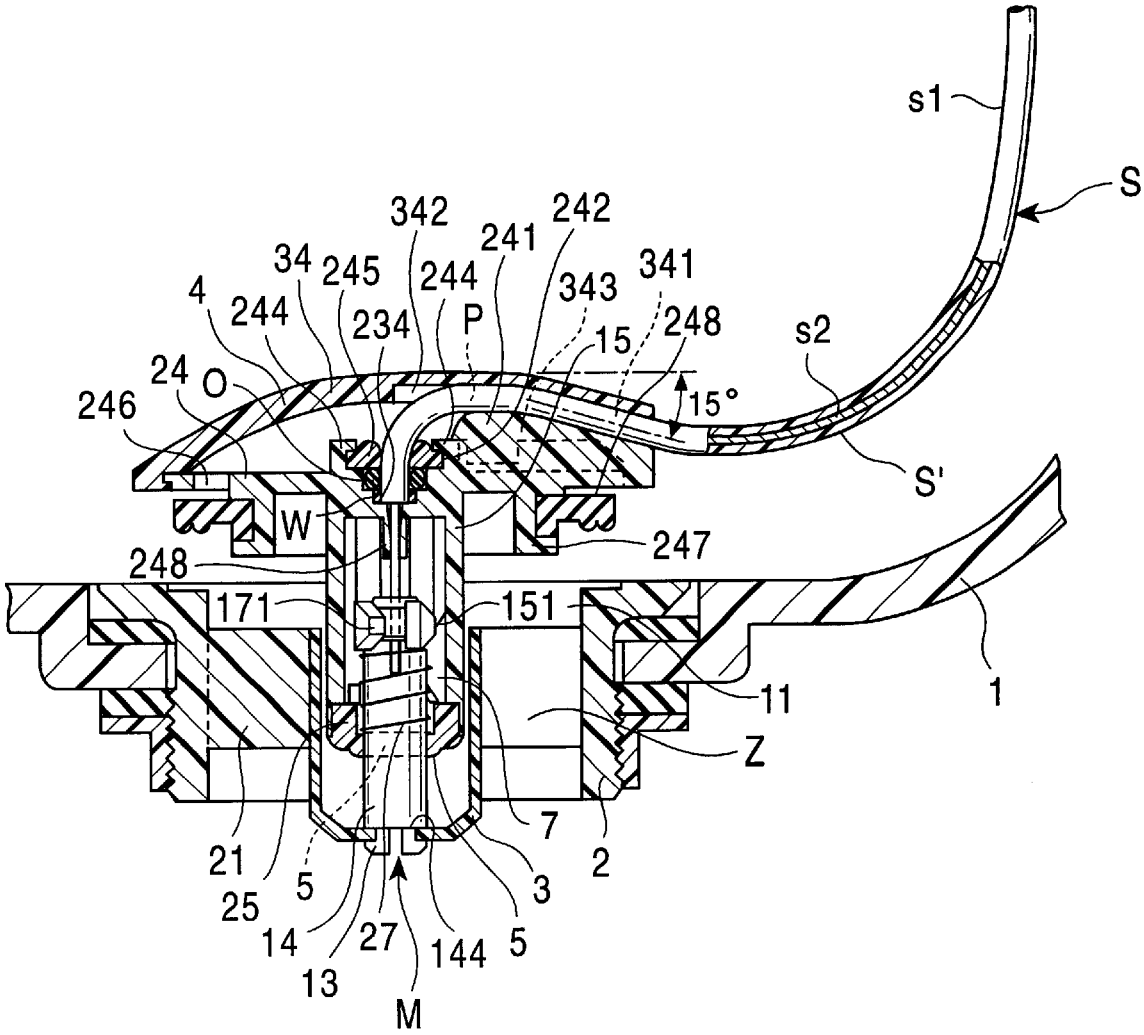
FIG. 7 is an enlarged sectional view for a substantial part to illustrate a valve opened state.

In addition, feeding and holding of the releasing member S in its upward inclined state causes a direction changing part S' of the releasing member S wired along the bath tub 1 to be positioned at a lower location than that of the feeding port 341 as shown in FIG. 7 and then a resilient force can be utilized at the direction changing part S' as a pushing force for pushing the plug lid 4 in such a direction as one in which it is closely contacted with the drain port 11.

Then, a second preferred embodiment shown in FIGS. 8A and 8B will be described as follows, wherein the preferred embodiment is made such that the thrust lock mechanism 7 is not installed within the aforesaid ascending or descending member 5 but the thrust lock mechanism 7 is arranged within the operating part 6 and other constituents are similar to those of the aforesaid first preferred embodiment, so that the detailed description about the other constituents will be eliminated.

The operating part 6 is of a well-known structure comprised of a releasing guide main body 16, an operating shaft 36 inserted into the releasing guide main body 16 in such a way that it can be moved up and down with one end of releasing member S being connected to its lower end, and a thrust lock mechanism 7 arranged between the operating shaft 36 and the releasing guide main body 16 (refer to the gazette of Japanese Patent Laid-Open No. Hei 9-324451).

Further, the arrangement in which the releasing guide main body 16 is fixed at the desired position in the bath tub 1 by a fixing means 56 such as a double-surface adhering tape or a suction pad and the like in such a way that it may be removed is similar to that of the aforesaid preferred embodiment.

The thrust lock mechanism 7 is comprised of the aforesaid fixed ring 37 arranged at the upper end of the operating shaft 36 within the releasing guide main body 16, the aforesaid rotary ring 47 coaxially, rotatably and freely fitted to the lower part of the operating shaft 36 than that of the fixed ring and a guiding part 57 arranged at the inner surface of the releasing guide main body 16, wherein a position setting spring 67 is placed between the upper surface of a protrusion 161 circumferentially arranged at the midway part of the operating shaft 36 and the rotary ring 47 and at the same time a spring 77 is placed between the lower surface of the protrusion 161 and the bottom part of the releasing guide main body 16.

This thrust lock mechanism 7 is constructed such that its locking operation and its locked state releasing operation are carried out at a descending side in an upward or downward motion passage every time the operating shaft 36 is pushed against a biasing force of the spring 77.

The fixed ring 37 is formed such that its lower part has a saw-teeth section (not shown) and its side part has several protrusions (not shown). The rotary ring 47 is of a form well known nowadays having a saw-teeth section (not shown) at its upper part which is coincided with the saw-teeth section (not shown) and having several protrusions (not shown) at its side part, wherein the guiding part 57 has a form in which a guiding groove (not shown) having the aforesaid fixed ring 37 and the protrusion of the rotary ring 47 entered therein and a saw-teeth section (not shown) are alternatively arranged.

Although not shown, the other end (lower end) of the releasing member S is fed into the plug lid 4 from the side part of the plug lid 4 in the same manner as that of the aforesaid preferred embodiment and held in it to cause the outer tube s1 to be bent within the plug lid 4 in a downward curved state and further to cause the extremity end (the other end) of the outer tube s1 to be liquid-tightly connected to the bottom part of the plug lid 4 and then the inner wire s2 is abutted against or approached to the bottom part of the upper end indentation 143 of the aforesaid supporting shaft 14.

Action of the drain plug device of the second preferred embodiment having such a configuration as described above will be described as follows, wherein FIG. 8A shows that the thrust lock mechanism 7 is kept at a locked state releasing condition, i.e. the plug lid 4 is kept at is opened state (the plug is closed). When the operating shaft 36 is pushed from this state, the inner wire s2 moves forward to push the supporting shaft 14, although the lower end of the supporting shaft 14 is kept engaged by the aforesaid engaging means M in such a way that it may not be moved, so that the inner wire s2, unable to force the supporting shaft 14 downward, forces the ascending or descending member 5, connected to the plug lid 4 at its upper end, to be lifted up in the same manner as that of the aforesaid preferred embodiment. With such an arrangement as above, the rotary ring 47 is pushed down by the fixed ring 37 to a place below the guide part 57, the saw-teeth of the rotary ring 47 are abutted against the saw-teeth of the fixed ring 37 and slightly rotated and when the pushing operation is stopped, it may receive the biasing force of the spring 77 to cause the protrusion of the rotary ring 47 to be engaged with the saw-teeth of the guide part 57, locked at the descending end and then the drain port 11 is opened (the plug is opened) (FIG. 8B).

Then, when the operating shaft 36 is pushed, the saw-teeth of the rotary ring 47 are slightly rotated by the saw-teeth of the fixed ring 37 and when the pushing operation is stopped, the rotary ring 47 causes the saw-teeth to be abutted against the saw-teeth of the guide part 57 and slightly rotated, thereafter the protrusion enters into the guiding groove to cause its locked state to be released, the plug lid 4 drops automatically together with the ascending or descending member 5 to close the drain port (the plug is closed) (FIG. 8A).

Then, a third preferred embodiment of the present invention shown in FIG. 9 will be described as follows, wherein this preferred embodiment discloses the drain plug device A in which the thrust lock mechanism 7 is not used, but the plug lid 4 is lifted up together with the ascending or descending member 5 to open the drain port 11 (the plug is opened) and further the drain port 11 is closed (the plug is closed).

Further, the feature in which the releasing member S is fed into the plug lid 4 from the side part of the plug lid 4 and held to cause the outer tube s1 to be bent downward in the plug lid 4 under a curved state and further causes the extremity end (the lower end) of the outer tube s1 to be connected to the portion just above the ascending or descending member 5 at the bottom part of the plug lid 4, the inner wire s2 is positioned to be abutted or approached to the bottom part of the indentation 143 recessed at the upper end of the supporting shaft 14 is similar to those of the aforesaid first and second preferred embodiments.

In this preferred embodiment, the guide cylinder 76 is projected from the bottom part of the releasing guide main body 16 of the operating part 6 into the inner part, the operating shaft 36 is press contacted with the guide cylinder 76 in such a way that it can be moved up and down, the upper end acting as one end of the inner wire s2 is fixed to the operating shaft 36 and pushed, thereby the plug lid 4 is lifted up together with the ascending or descending member 5 in the same manner as that of the first and second preferred embodiments, a descended position of the operating shaft 36 when the drain port 11 is opened (the plug is opened) is held by a press contacting force with the guide cylinder 76, the lifted-up position of the operating shaft 36 when the inner wire s2 advancing forward through the pulling-up operation of the operating shaft 36 is recovered back to its original state is held by the press contacting force with the guide cylinder 76, the ascending or descending member 5 and the plug lid 4 are dropped automatically to open the drain port 11 (the plug is closed).

In the preferred embodiment of the present invention, since the pulling-up operation is required, it is more preferable to use the inner wire composed of a single core wire or a twisted wire than to use the coil-like inner wire s2 composed of metallic material.

Then, the fourth preferred embodiment shown in FIGS. 10 to 12 and the fifth preferred embodiment shown in FIG. 13 will be described as follows, wherein the preferred embodiments correspond to the case in which the aforesaid guiding part 3 is of an attachment type to install the drain plug device A indicated in the aforesaid first to third preferred embodiments to the drain port fixing member (a drain port fitting) 2 corresponding to the rubber plug. FIGS. 10 to 12 show a system in which the attachment member 23 has integrally an annular flange 231 and a guiding part 232 facing against the annular flange 231 through a drain'space Z. FIG. 13 shows a system in which the attachment member 23 has separately the annular flange 231 and the guiding part 232 for it.

Both attachment members 23 above are molded by hard synthetic resin material, wherein the annular flange 231 has an opening with a diameter smaller than that of the upper end of the drain port 11, a double-surface tape 233 is applied to an entire rear surface and this is adhered to and fixed to the upper flange 12 of the drain port fixing member (the drain port fitting) 2 with an adhering force of the double-surface tape 233.

In turn, in the case that the guiding part 232 is integrally formed with the annular flange 231, the guiding part 232 is cooperatively arranged through a supporting bracket 234 having a cross-shape as seen in its top plan view.

A shape of this guiding part 232 is approximately the same as that of the guiding part 3 integral with the drain port fixing member (the drain port fitting) described in the first to third preferred embodiments and it is apparent that the engaging indentation 144 at the lower end of the supporting shaft 14 is engaged with its bottom part and the engaging hole 13 constituting the aforesaid engaging means M is opened.

In addition, in the case of the separate arrangement shown in FIG. 13, the guiding part 232 is applied from above against the annular flange 231 in such a way that it is removably fitted by the engaging means D.

This engaging means D is made such that a downward fine tapered cylindrical receiving section 231*a* is vertically suspended from an opening edge of the annular flange 231, and in turn the extremity end of the supporting bracket 232*a* having a cross-shape as seen in a top plan view cooperatively arranged at the guiding part 232 is provided with a fitting part 232*b* fitted in accommodation to the aforesaid receiving section 231*a* to enclose the guiding part 232, resilient hook pieces 232*c* resiliently hooked against the lower end of the aforesaid receiving section 231*a* are properly spaced apart and projected at the lower end of the fitted part 232*b*, wherein it is manually pulled up against the resilient engaging forces of the lower end of the receiving section 231*a* and the resilient hook pieces 232*c*, resulting in that a guiding part 232 having a fitted section 232*b* and supporting brackets 232*a* can be pulled out.

In addition, irrespective of integral formation or separate formation of the guiding part 232, an annular flange 231 is provided with cut marks 232*d* concentric with the circumferential edge of the flange 231, the flange is cut off along the cut marks 232*d* and then a diameter of the annular flange 231 is easily coincided with a diameter of the outer edge of the drain port fixing member (the drain port fitting) 2 which is different by each of the makers.

As a form of the aforesaid cut marks 232*d*, it is satisfactory that a mark line is merely drawn on it or a groove is formed on it. A fine diameter adjustment can be carried out and more convenience in use can be assured if not only a single number of groove, but also a plurality of grooves are concentrically arranged.

In addition, this attachment member 23 is not limited to a system in which it is adhered to the drain port fixing member (the drain port fitting) 2 having no guiding part 3, but it is also possible to perform a direct adhesion of it to the port edge of the drain port 11 and a direct use of it in place of the drain port fixing member 2.

It becomes possible to perform a superior outer appearance installation of a remote-operated type drain plug device A having its wiring set in a bath tub of the first to third preferred embodiments even if the drain port fixing member (the drain port fitting) 2 has a different size by each of the makers using the rubber plug by a method wherein the attachment member 23 having the cutting marks 232*d* is applied at the annular flange 231 whatever the aforesaid integral formation or separate formation may be made.

EFFECTS OF THE INVENTION

As described above, the present invention is constituted such that there is provided an engaging means for engaging with the lower end of the supporting shaft between the guiding part arranged at the center in the drain port and the lower end of the supporting shaft, so that the floating of the main bodies of the device (the plug lid and the ascending or descending member) caused by an instantaneous pushing-down force at the supporting shaft generated by pushing the operating part is prevented by the engaging action of the engaging means formed between the lower end of the supporting shaft and the guiding part and then it is possible to prevent an accident in which the main bodies of the device comprised of the plug lid and the ascending or descending member are flown out of the guiding part.

In addition, a releasing member comprised of a coil-like inner wire having a sufficient durability against a pushing force and a flexibility which can be accommodated for the bent part and slid smoothly without requiring any substantial force for the pushing operation at the operating part and an outer tube made of fluoro-resin having the same degree of flexibility as that of the inner wire, a predetermined durability against a tensile force, a high heat-resistance, a superior size holding characteristic and keeping a smooth sliding characteristic of the inner wire for a long period of time is used and utilized, so that even in the case that as described above, the outer tube is inserted into the plug lid from its side, bent in a downward curved form and connected to the bottom part of the plug lid at its extremity end under utilization of the characteristic of the releasing member, it is possible to keep a constant and smooth sliding motion of the inner wire in a stable manner, perform the pushing operation of the operating part with a quite light force and then the operability of it is improved.

Further, if the releasing member is drawn into the plug lid with its upward slant state directing toward the central side of the plug lid and the feeding port adjacent to the outside part has a diameter slightly larger than a diameter of the releasing member, the direction changing part (denoted by the reference symbol S') wired along the bath tub can be positioned at a lower location than that of the feeding port (refer to FIGS. 2A and 2B), a resilient recovering force generated at the direction changing part (denoted by the reference symbol S') can be effectively utilized as a pushing force for pushing the plug lid in a direction where it is closely contacted with the drain port and then a clearance at the feeding port can be utilized as a margin for preventing a cut loss of the releasing member in advance.

Further, in the case that the guiding part has integrally or separately the annular flange to be mounted on and fixed to the edge of the drain port fixing member, the remote-operated drain plug device wiring in the bath tub can be easily fixed afterwards to the drain port fixing member (the drain port fitting) using the rubber plug and if the guiding part is separate from the annular flange, the guiding part can be removed and it does not become a hindrance when the drain port is cleaned up to its corners and further if if its engaging or removing can be carried out from above, it can be rapidly accommodated for it even if the guiding part is damaged.

In addition, in the case of the system in which the annular flange is provided with cut marks, it becomes possible to align the edge (outer edge) of the annular flange with an edge diameter (outer edge) of the drain port fixing member (the drain port fitting) using the rubber plug having different size by every makers and so an aesthetic outer appearance of the drain port is not damaged.

Having described specific examples of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A drain plug device comprising:

a hollow ascending/descending member connected to a plug lid, the ascending/descending member being configured to move up and down in a guiding part arranged at a central part in a drain port of a vessel;

a supporting shaft insertable into the ascending/descending member;

a releasing member connected at a first end to an operating part arranged in the vessel and, at a second end, to the plug lid, the releasing member comprising an inner wire operated by a pushing operation of the operating part; and an engaging mechanism positioned between a lower end of the supporting shaft and the guiding part, the engaging mechanism being configured to engage the lower end of the supporting shaft, holding the supporting shaft immobile;

wherein a forward motion of the inner wire abuts a lower end of the inner wire against the supporting shaft, causing a downward force against the immobile supporting shaft, resulting in an upward force against the ascending/descending member, which moves upward and lifts the connected plug lid to open the drain port.

2. The drain plug device according to claim 1, the releasing member further comprising an outer tube in which the inner wire is slidably contained, the inner wire comprising a coil of a metallic material and the outer tube comprising a tetrafluroethylene resin;

wherein the outer tube is configured to enter the plug lid from a side part of the plug lid, bend in a downward curved form within the plug lid, and connect to a bottom part of the plug lid to guide the inner wire within the ascending/descending member.

3. The drain plug device according to claim 2, wherein the releasing member is positioned in an upward-directed slant toward a central part of the plug lid; and wherein a diameter of a feeding port of the side part of the plug lid is slightly larger than a diameter of the outer tube of the releasing member.

4. The drain plug device according to claim 1, wherein the guiding part comprises an integral annular flange portion and an inner guiding portion, a drain space being defined between the annular flange portion and the guiding portion;

wherein the annular flange portion is connected to a circumferential edge part of the drain port such that the guiding portion is positioned at a central part of the drain port.

5. The drain plug device according to claim 4, wherein the annular flange portion comprises at least one cut mark concentric with a circumferential edge of the annular flange.

6. A drain plug device comprising:

a guiding part positioned in a drain port;

a hollow moving member slidably positioned in the guiding part and connected at one end to a plug lid;

a supporting shaft insertably positioned within the moving member;

a releasing member connected at a first end to an operating part and at a second end to the plug lid, the releasing member comprising an inner wire movably connected to the operating part; and an engaging mechanism positioned between a lower end of the supporting shaft and the guiding part, the engaging mechanism holding the supporting shaft immobile;

the operating part being configured such that movement of the operating part causes the inner wire to exert a force against the immobile supporting shaft and to move the moving member and the plug lid connected to the moving member.

* * * * *